US005202606A

United States Patent [19]

Vrijssen et al.

[11] Patent Number: 5,202,606

[45] Date of Patent: Apr. 13, 1993

[54] CATHODE-RAY TUBE WITH FOCUSSING STRUCTURE AND GETTER MEANS

[75] Inventors: Gerardus A. H. M. Vrijssen; Willem M. Van Alphen; Ger-Wim J. Goorhuis, all of Eindhoven, Netherlands

[73] Assignee: U.S. Philips Corporation, New York, N.Y.

[21] Appl. No.: 827,520

[22] Filed: Jan. 27, 1992

Related U.S. Application Data

[63] Continuation of Ser. No. 541,001, Jun. 20, 1990, abandoned.

[30] Foreign Application Priority Data

Jun. 23, 1989 [NL] Netherlands ..... 8901587
Jan. 18, 1990 [NL] Netherlands ..... 9000117

[51] Int. Cl.[5] ..... H01J 29/06; H01J 29/94

[52] U.S. Cl. ..... 313/450; 313/560; 313/481

[58] Field of Search ..... 313/481, 450, 560

[56] References Cited

U.S. PATENT DOCUMENTS

| | | | |
|---|---|---|---|
| 3,432,712 | 3/1969 | Benda | 313/181 |
| 3,979,633 | 9/1976 | Davis et al. | 313/481 |
| 4,220,893 | 9/1980 | Miller et al. | 313/450 |
| 4,221,991 | 9/1980 | Speigel | 313/481 |
| 4,231,627 | 11/1980 | Schaffernicht et al. | 316/25 |
| 4,665,340 | 5/1987 | Odenthal et al. | 313/449 |
| 4,806,821 | 2/1989 | von Gorkum | 313/449 |
| 4,885,503 | 12/1989 | Takahashi et al. | 313/450 |
| 4,945,283 | 7/1990 | Van Der Heijden et al. | 313/450 |

FOREIGN PATENT DOCUMENTS

| | | | |
|---|---|---|---|
| 154147 | 9/1983 | Japan | 313/481 |

*Primary Examiner*—Palmer C. Demeo
*Attorney, Agent, or Firm*—Robert J. Kraus

[57] ABSTRACT

The invention relates to a cathode-ray tube 1 having an electron gun 3 positioned in a neck portion 2. The electron gun 3 is provided with a focusing structure 10 which includes a hollow tube 12 of electrically insulating material. A layer 14 of a material having a high resistance is applied to the inner surface of the hollow tube. The resistance layer 14 is shielded from a getter arrangement 44 positioned in the cathode ray tube 1.

10 Claims, 6 Drawing Sheets

CATHODE-RAY TUBE WITH FOCUSSING STRUCTURE AND GETTER MEANS

This is a continuation of application Ser. No. 07/541,001, filed Jun. 20, 1990, now abandoned.

BACKGROUND OF THE INVENTION

The invention relates to a cathode ray tube having an envelope, comprising on the one side a luminescing screen and on the other side a neck portion, having an electron gun which is positioned in the neck portion and which includes a beam-forming portion and a focusing structure, the focusing structure including an open-ended hollow tube of an electrically insulating material, having an inner surface on which a layer of a material having a high electrical resistance is deposited and a getter arrangement provided in the envelope.

Such a cathode ray tube can be used in black/white colour and projection television, in arrangements for displaying figures and letters (Data Graphics Display) and in other arrangements in which a cathode ray tube is used.

Although in theory an accurate focusing may be obtained by means of a layer of a material having a high electrical resistance, which layer is, for example, of a helical structure and over whose extremity a voltage difference is applied, it was found in practice that the focusing does not always come up to the expectations.

SUMMARY OF THE INVENTION

It is, inter alia, an object of the invention to provide a cathode ray tube provided with an electron gun having a focusing structure of the type defined in the opening paragraph which provides an accurate focusing.

According to the invention, a cathode ray tube of the type defined in the opening paragraph, is characterized, in that the layer on the inner surface of the hollow tube is shielded from the getter arrangement.

The invention is based on the following recognition.

Generally, the envelope is evacuated during the production of a cathode-ray tube. The cathode-ray tube is heated to a temperature of, for example, about 400° C. to promote degassing of the parts of the cathode-ray tube. It is customary to place a getter arrangement in the cathode-ray tube to bind the gases released during evacuation and also during the operating life of the cathode-ray tube. This getter arrangement contains a material which is able to bind the released gases. In television tubes, for example, the material contains inter alia metallic barium. To obtain a sufficient gas binding, the getter material is generally placed in the envelope and vaporised in a manufacturing step (gettering), so that a layer of finely distributed getter material is formed, for example on the inner wall of the envelope. The invention is based on the recognition that the required high electrical resistance of the layer (of the order of, for example $10^{10}$ Q) is unintentionally reduced during this gettering operation because electrically conducting getter material may land on the layer of resistance material. If the high-ohmic resistance layer has a helical structure, then the generated focusing field may be disturbed, as precipitated getter material causes a short-circuit between the individual turns.

In the cathode ray tube according to the invention, the inner surface of the hollow tube is shielded from the getter arrangement, which means that the layer of a material having a high electrical resistance of the focusing arrangement is shielded from getter material precipitating thereon during the gettering operation. This shielding is effected by a specific positioning of the hollow tube and the getter arrangement relative to each other and/or by using shielding means.

In conventional electron guns having focusing lenses formed from metal cans, the fact whether getter material falls or does not fall on the focusing lens parts has no consequence for the focussing effect of the electron gun.

In a cathode-ray tube in which a getter arrangement is provided between the end of the hollow tube and the luminescing screen, for example on the anode contact, the inner surface of the hollow tube is effectively shielded in an embodiment of the invention, from the getter arrangement, because an open-ended auxiliary tube is provided at the end of the hollow tube facing the luminescing screen, the axis of which is substantially in line with the axis of the hollow tube. It was found in practice that the vaporised getter material mainly precipitates on the end of the hollow tube facing the luminescing screen. By providing the hollow tube with an open-ended auxiliary tube, the getter material vaporised towards the end of the hollow tube precipitates to a large extent or completely onto the auxiliary tube and not on the high ohmic resistance layer.

Even when the getter arrangement is not provided between the end of the hollow tube and the luminescing screen, but, for example, around the hollow tube, the shielding of the resistance layer from vaporised getter material by the auxiliary tube is more efficient. The auxiliary tube is, for example, cylindrical or conical.

In a preferred embodiment of a cathode-ray tube according to the invention, the smallest inner diameter of the auxiliary tube is less than the inner diameter of the hollow tube. If the inner diameter of the auxiliary tube is less than the inner diameter of the hollow tube, then the auxiliary tube functions also as a diaphragm. As a result of its acting as a diaphragm, the shielding of the high ohmic layer of the inner surface of the hollow tube is efficient.

An accurate shielding is also obtained if a diaphragm is attached to the end of the hollow tube.

A further preferred embodiment of a cathode ray tube according to the invention, is characterized in that the auxiliary tube is made of an electrically insulating material.

Generally during operation of a cathode ray tube, a generated electron beam is deflected over the luminescing screen by means of a deflection unit. The deflection field generated by the deflection unit may extend as far as or even into the focusing structure. By manufacturing the auxiliary tube from an electrically insulating material, the deflection field is not influenced disadvantageously. It is efficient for the auxiliary tube to be part of the hollow tube. This requires less separate parts in the cathode-ray tube.

An alternative embodiment of a cathode-ray tube according to the invention, in which the deflection field to be generated is substantially not influenced disadvantageously, is characterized in that the auxiliary tube is manufactured from an electrically insulating material and is provided with at least one gap which extends substantially parallel to the axis of the hollow tube. The gaps in the auxiliary tube prevent eddy currents from occurring in the auxiliary tube, which might disturb the deflection field.

Preferably, the getter arrangement is attached in a position between the end and the luminescing screen at the end of the hollow tube, so that the getter arrangement having the focusing structure is integrated and less separate parts are required in the cathode-ray tube.

A further preferred embodiment of a cathode-ray tube according to the invention is characterized, in that the getter arrangement is located in the neck portion between the hollow tube and the inner surface of the neck portion. As a result thereof the vaporised getter material lands largely or completely on the outer surface of the hollow tube and on the inner surface of the neck portion, minimizing the chance that the electrical resistance of the layer at the inner surface of the hollow tube is influenced disadvantageously.

To prevent vaporised getter material from landing on the high ohmic resistance layer via the ends of the hollow tube facing away from the luminescing screen during gettering, a shield is located, in a preferred embodiment of a cathode-ray tube according to the invention, between the end of the hollow tube opposite the phosphor screen and the inner surface of the neck portion of the cathode-ray tube. This causes the vaporised getter material to land on the shield.

BRIEF DESCRIPTION OF THE DRAWING

Some embodiments of a cathode-ray tube according to the invention will now be described in greater detail by way of example, with reference to the accompanying drawing, wherein.

DESCRIPTION OF THE PREFERRED EMBODIMENTS

Figure 1:
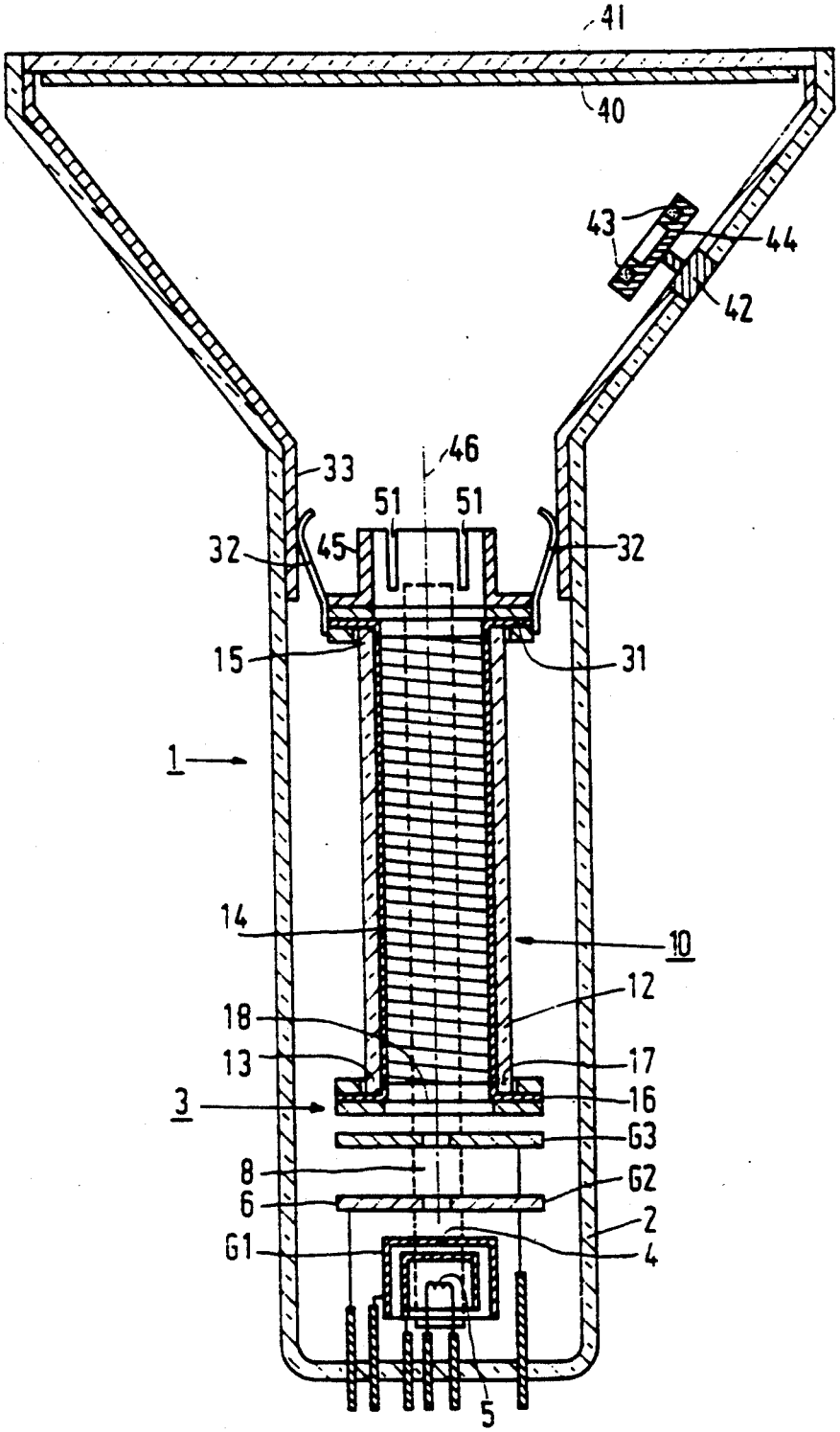
FIG. 1 shows schematically a longitudinal cross-section of a cathode ray tube according to the invention, and FIGS. 2 to 6 each show schematically a longitudinal cross-sectional view of an alternative embodiment according to the invention.

In FIG. 1 a cathode-ray tube comprising a luminescing screen, for example a phosphor screen 40 deposited on a display window 41 and an electron gun 3 mounted in a neck portion 2, is shown. A G1 (grid) electrode structure is provided with a typical aperture behind which a cathode 4 having an electron-emitting surface is deposited, with a heater 5 bordering thereon. A G2 electrode structure, in this case constituted by a metal sheet 6 having a central aperture, is located more to the front, bordering on the G1 electrode structure. A G3 electrode structure, constituted by a metal sheet is located even more to the front. To form an assembly, the electrode structures G1, G2 and G3, which constitute the beam producing portion—in this case the triode portion—of the gun, are attached to insulating mounting rods via pins (or brackets), one of them (8) being shown in FIG. 1. In this case two rods are used. However, the invention is not limited thereto. For example, four or three mounting rods may be used in an alternative and in itself customary manner. A focusing structure 10 includes a hollow tube 12 of an electrically insulating material, for example glass or ceramic, which hollow tube 12 is coated on its inner surface with a layer 14 of a material having a high electrical resistance. The tube 12 is rigidly connected to a fold edge 17 of a metal sheet 16 at its end 13, which fold edge 17 surrounds an aperture 18 in the sheet 16 via which metal sheet 16 it is attached to the mounting rods to which also the beam-forming portion of the gun is secured. The tube 12 is secured to the mounting rods at its end 15 in a similar manner, by means of a metal sheet 31. To obtain an accurate focusing, a voltage difference is applied across the ends of the layer by connecting the metal sheets 16 and 31 to external voltage sources (not shown in FIG. 1). The layer 14 may have the shape of one or more rings, or it may have, for example a helical shape or a combination of one or more rings with a helix. The electron gun 3 is positioned in the neck portion 2 by means of a centering unit having flexible elements 32 in this embodiment. The flexible elements 32 also provide an electrical connection between the sheet 31 and an electrically conducting layer 33 deposited on the inner surface of the envelope of the cathode-ray tube.

In the envelope, the anode contact 42 is present for applying a desired potential to the conducting layer 33. A getter arrangement 44 is provided on the anode contact 42.

The getter arrangement 44 contains getter material which is capable of binding the gases released and thus provides the vacuum in the envelope. To obtain an appropriate gas binding, the getter material 43 is vaporised in a manufacturing step, so that a layer of finely distributed getter material is formed. Connected to the end 15 of the hollow tube 12 facing the phosphor screen 14 is an open-ended auxiliary tube 45, the axis 46 of which is substantially located in the extension of the axis 47 of the hollow tube 12. Because of the fact that the getter material, vaporised in the direction of the hollow tube 12, precipitates largely or completely onto the auxiliary tube 45, the inner surface of the hollow tube 12 on which the resistance layer 14 is provided, is shielded from the getter material. The electrical resistance of the resistance layer 14 and the focusing of the focusing structure 10 is not influenced disadvantageously by the vaporised getter material, neither substantially nor to a large extent, because of the presence of the auxiliary tube 45.

Figure 2:
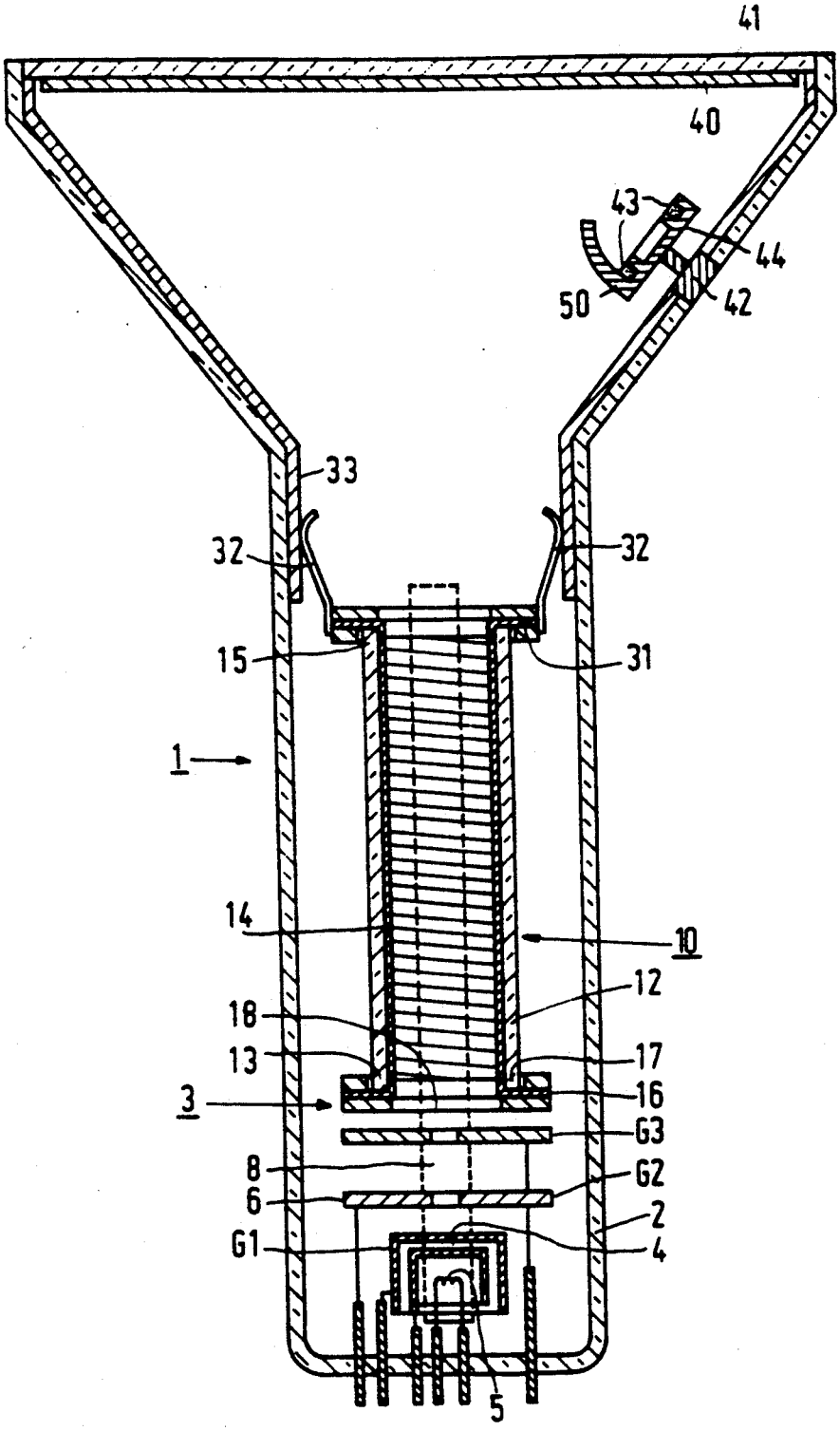

FIG. 2 shows schematically an alternative embodiment of a cathode ray tube according to the invention in a longitudinal cross-sectional view. The same reference numerals denote the same components in FIGS. 1 and 2. In this embodiment, the getter arrangement 43 is provided with a shield 50. This shield 50 is positioned between the getter material 43 and the hollow tube 12. Vaporised getter material will precipitate on the shield 50 and substantially no vaporised getter material will land on the high ohmic resistance layer 14. The resistance layer 14 is thus shielded from the getter arrangement 43.

During operation of the cathode ray tube, the generated electron beams are deflected over the phosphor screen 40 be means of a deflection unit (not shown). The deflection field generated by the deflection unit may extend to as far as or even into the hollow tube 12 of the focusing structure. The auxiliary tube 45 must not exercise any substantially disadvantageous influence on this deflection field, especially at high frequencies.

If the auxiliary tube 45 is made from a metal, as it is in FIG. 1, then the deflection field is not influenced substantially disadvantageously when the auxiliary tube 45 is provided with one or more slots 51. The number of slots 51 to be made in the auxiliary tube 45, depends on the disadvantageous influence of the auxiliary tube 45 on the deflection field.

Preferably, the auxiliary tube 45 is made of an electrically insulating material, for example glass. Thus, a generated deflection field is not influenced disadvantageously in a simple manner. In FIG. 1 the inner diameter of the auxiliary tube 45 is equal to that of the hollow tube 12. The inner diameter of the auxiliary tube 45 is preferably smaller than that of the hollow tube 12, so that the resistance layer 14 is shielded from the getter arrangement to an improved extent.

Figure 3:
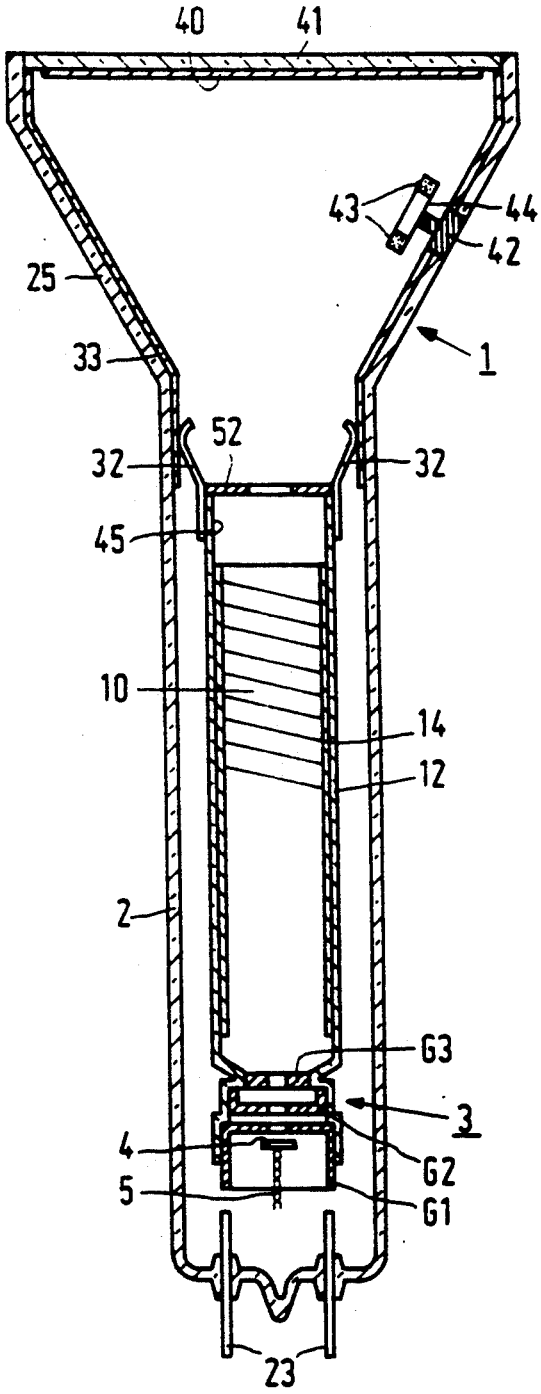

FIG. 3 is a schematical longitudinal cross-sectional view of an alternative embodiment of a cathode ray tube according to the invention. In this embodiment, the hollow tube 12 carries both the focusing structure 10 and the electrodes of the beam-forming portion. The supply of electrical potentials to the electrodes of the beam-forming portion is, for example, achieved by means of feed-through wires (not shown in FIG. 3) through the hollow tube 12. The hollow tube 12 is suspended in the neck portion 2 from connection pins 23 and by flexible elements 32. In this embodiment the auxiliary tube 45 is an extended portion of the hollow tube 12. The end of the auxiliary tube 45 is closed by a diaphragm 52, onto which a portion of the vaporised getter material precipitates. The resistance layer 14 on the inner surface of the hollow tube 12 extends as far as the auxiliary tube 45.

It was found in practice that, when the auxiliary tube 45 has an inner diameter equal to that of the hollow tube 12 and a length of 15 mm, substantially all the vaporised getter material precipitates onto the inner surface of the auxiliary tube 45. In this case the diaphragm 52 onto which a portion of the vaporised getter material precipitates, is even superfluous. The resistance layer 14 is thus shielded from the getter arrangement, without unnecessarily increasing the number of components of the cathode-ray tube.

Figure 4:
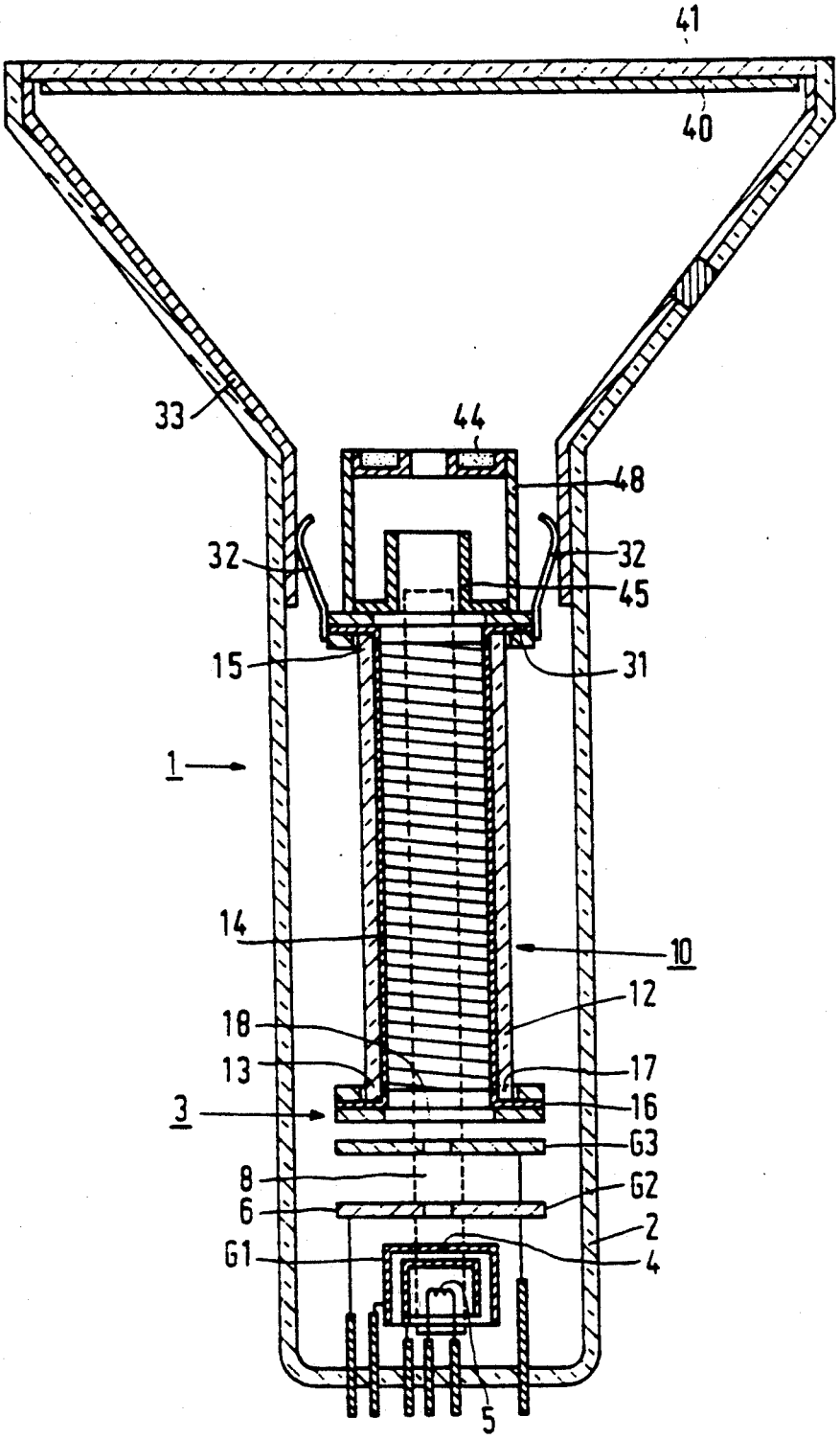

FIG. 4 shows schematically a portion of a cathode-ray tube according to the invention, in which the hollow tube 12 carries both the focusing structure 10 and the auxiliary tube 45 and furthermore the getter arrangement 44. The getter arrangement 44 is attached to the centering unit with flexible elements 32 by means of metal strips 48.

In this embodiment the getter arrangement is located at 22 mm from the end of the hollow tube 12 in the direction of the phosphor screen 40. The hollow tube 12 has an inner diameter of 10 mm. The auxiliary tube 45 has a length of 7 mm and an inner diameter of 6 mm. Because of the fact that the auxiliary tube 45 has a smaller inner diameter than the hollow tube 12, the auxiliary tube 45 functions as a diaphragm. A length of 7 mm was found to be sufficient to realise that substantially no vaporised getter material precipitates onto the resistance layer 14. An integrated unit is thus created, which can be handled well during manufacture of the cathode-ray tube and in which the resistance layer 14 is sufficiently shielded from the getter arrangement 44 in spite of the compact structure in which the getter arrangement 44 is positioned at a relatively short distance from the hollow tube 12.

Figure 5:
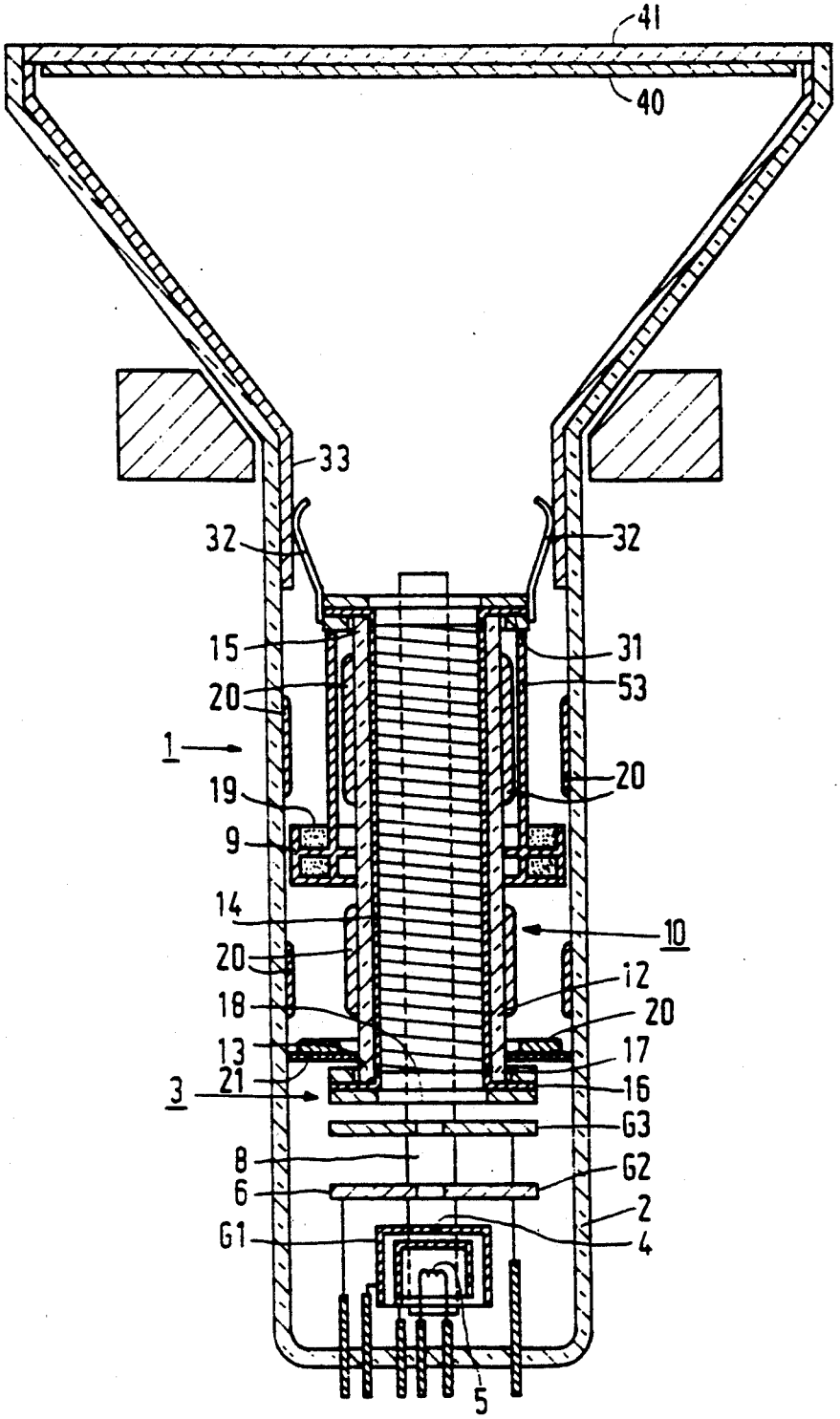

FIG. 5 shows an alternative embodiment of a cathode-ray tube according to the invention. In this case the getter arrangement 9 is located in the neck portion 2 around the hollow tube 12. The getter arrangement 9 contains getter material 19 which after gettering forms a layer 20 of finely distributed getter material. This layer 20 of vaporised getter material is located substantially completely on the outer surface of the hollow tube 12 and at the inner surface of the neck portion 12. Because of this structure substantially no getter material lands on the resistance layer 14. In this embodiment the getter arrangement 9 is annular and is attached to the centring unit by means of strips 53. However the invention is not limited thereto. It is, for example, possible for the getter arrangement to be attached also to the mounting rods, one of which (8) is shown, or to be supported by the hollow tube 12 or the neck portion 2.

A shield 21, in this case an annular shield, is provided near the end 13 of the hollow tube 12, between the hollow tube 12 and the inner surface of the neck portion 2. Getter material which travels towards the cathode 4 during gettering, consequently lands on the annular shield 21. This prevents getter material from precipitating onto the high ohmic resistance layer via the ends 13 of the hollow tube. The shield 21 may, for example, be made from a metal or an insulating material.

Figure 6:
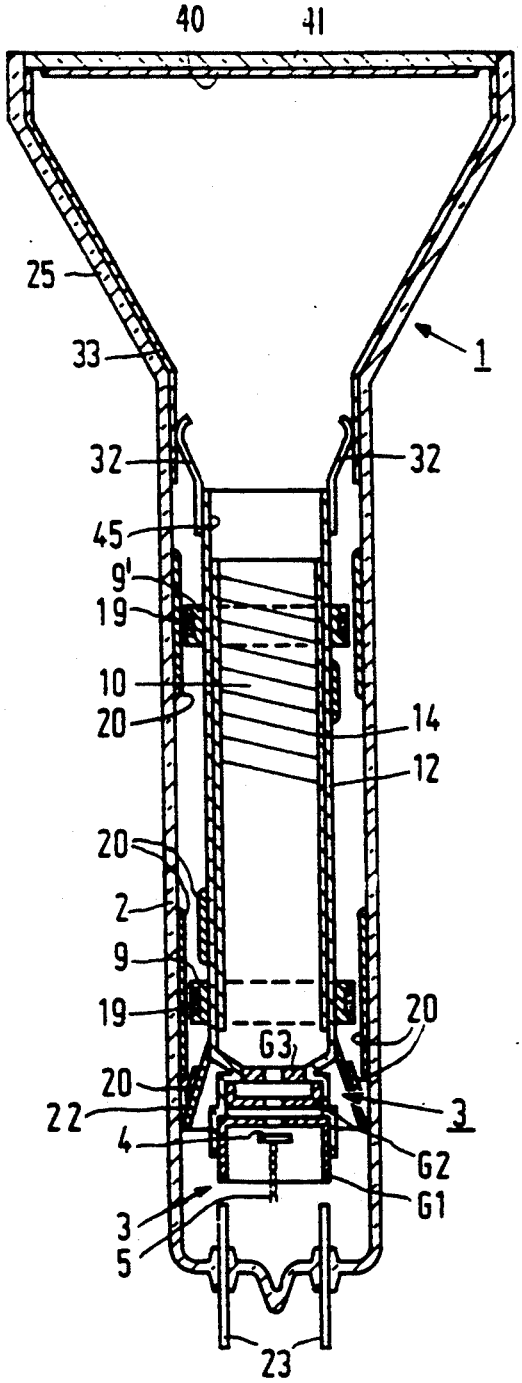

In the embodiment of a cathode-ray tube according to the invention as shown in FIG. 6, the getter arrangement is formed by two annular channels 9 and 9', which may be attached directly or indirectly to the hollow tube 12, whereby a simple structure is obtained. Before the gettering procedure, the getter material is contained in the channels. After having been vaporised, the getter material is at least partly present on the outer surface of the hollow tube 12 and on the inner surface of the neck portion 2.

A conical shield 20, the diameter of which tapers down towards the phosphor screen in this case, is arranged between the hollow tube 12 and the inner surface of the neck portion 2 and thus prevents unwanted precipitation of getter material onto the high ohmic resistance layer 14.

Because of the fact that in a cathode ray tube according to the invention hardly any or no getter material at all lands on the focusing structure, an appropriate focusing of the electron beams on the phosphor screen is obtained.

The invention has been described with reference to a cathode ray tube having one electron gun, but it will be obvious to a person skilled in the art that the invention is also suitable for use in colour cathode-ray tubes.

We claim:

1. A cathode ray tube comprising an envelope having a display window bearing a luminescent screen and a neck portion containing an electron gun for producing an electron beam directed to the luminescent screen, said envelope containing getter means for producing within the envelope during a gettering operation a distribution of getter material, characterized in that:

a. the electron gun includes a focusing structure comprising a hollow focusing tube of electrically insulating material disposed about an axis, said tube having an inner surface on which a layer of material having a high electrical resistance is disposed in a predetermined pattern and having at least one open end; and b. the cathode ray tube includes means for inhibiting the deposition of the getter material on the layer of high electrical resistance material, comprising:

(1) first means for orienting the getter means such that it deposits the getter material at a substantial distance from said at least one open end of the focusing structure; and (2) second means for shielding the layer of high electrical resistance material against deposition thereon of the getter material, during the gettering operation.

2. A cathode ray tube as in claim 1 where the second means comprises a hollow auxiliary tube disposed about the axis and extending from said at least one open end of the hollow focusing tube.

3. A cathode ray tube as in claim 2 where the auxiliary tube has an inner diameter which is smaller than an inner diameter of the focusing tube.

4. A cathode ray tube as in claim 2 or 3 where the auxiliary tube comprises an electrical insulating material.

5. A cathode ray tube as in claim 4 where the auxiliary tube is integral with the focusing tube.

6. A cathode ray tube as in claim 2 or 3 where the auxiliary tube comprises an electrically conductive material and includes at least one slot extending parallel to said axis.

7. A cathode ray tube as in claim 2 or 3 where the getter means is secured to the electron gun at a position located between the auxiliary tube and the luminescent screen.

8. A cathode ray tube as in claim 1, 2 or 3 where the getter means is disposed between the neck portion of the envelope and the focusing structure.

9. A cathode ray tube as in claim 1, 2 or 3 where the getter means comprises an annular channel.

10. A cathode ray tube as in claim 8 where the second means comprises a shield disposed between the neck portion of the envelope and the focusing structure and positioned between the getter means and the at least one open end of the hollow focusing tube.

* * * * *